US009978326B2

(12) United States Patent
Kim et al.

(10) Patent No.: US 9,978,326 B2
(45) Date of Patent: May 22, 2018

(54) LIQUID CRYSTAL DISPLAY DEVICE AND DRIVING METHOD THEREOF

(71) Applicant: Samsung Display Co., Ltd., Yongin (KR)

(72) Inventors: Yun-Mi Kim, Yongin (KR); Ki-Hyun Pyun, Yongin (KR); Sung-Jun Kim, Yongin (KR); Ju-Hyun Kim, Yongin (KR); Yong-Jae Lee, Yongin (KR); Jeong-Doo Lee, Yongin (KR); Kyung-Hwa Lim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 289 days.

(21) Appl. No.: 14/728,383

(22) Filed: Jun. 2, 2015

(65) Prior Publication Data

US 2016/0086561 A1 Mar. 24, 2016

(30) Foreign Application Priority Data

Sep. 22, 2014 (KR) ..... 10-2014-0125943

(51) Int. Cl.
*G09G 3/36* (2006.01)

(52) U.S. Cl.
CPC ..... *G09G 3/3655* (2013.01); *G09G 3/3696* (2013.01); *G09G 2310/08* (2013.01); *G09G 2320/0693* (2013.01)

(58) Field of Classification Search
None
See application file for complete search history.

(56) References Cited

U.S. PATENT DOCUMENTS

| | | | | |
|---|---|---|---|---|
| 2004/0196278 | A1 | 10/2004 | Kida et al. | |
| 2007/0195037 | A1 | 8/2007 | Kida et al. | |
| 2007/0195038 | A1 | 8/2007 | Kida et al. | |
| 2008/0225035 | A1 * | 9/2008 | Hsu | G09G 3/3648 345/212 |
| 2011/0063330 | A1 | 3/2011 | Bae et al. | |
| 2012/0218250 | A1 * | 8/2012 | Pei | G09G 3/3655 345/212 |

(Continued)

FOREIGN PATENT DOCUMENTS

| | | |
|---|---|---|
| KR | 10-2008-0012046 | 2/2008 |
| KR | 10-2014-0013523 | 2/2014 |

*Primary Examiner* — Christopher Kohlman
(74) *Attorney, Agent, or Firm* — H.C. Park & Associates, PLC

(57) ABSTRACT

A liquid crystal display device, including a display panel including data lines and gate lines intersecting the data lines, a gate driver configured to sequentially apply a scan signal to the gate lines, a data driver configured to apply data voltages corresponding to each gate lines to the data lines, a timing controller configured to control the gate driver and the data driver, a power source supply circuit configured to supply a positive power source and a negative power source, a common voltage feedback circuit configured to receive the positive power source and the negative power source from the power source supply circuit, receive a reference voltage and a common voltage from the display panel, and output an amplified feedback signal corresponding to a voltage level difference between the reference voltage and the common voltage.

9 Claims, 6 Drawing Sheets

(56) References Cited

U.S. PATENT DOCUMENTS

| | | | | |
|---|---|---|---|---|
| 2013/0033527 | A1* | 2/2013 | Yen | G09G 3/20 345/690 |
| 2013/0314393 | A1* | 11/2013 | Min | G09G 3/36 345/212 |
| 2014/0028535 | A1 | 1/2014 | Min et al. | |

* cited by examiner

LIQUID CRYSTAL DISPLAY DEVICE AND DRIVING METHOD THEREOF

CROSS-REFERENCE TO RELATED APPLICATION

This application claims priority from and the benefit of Korean Patent Application No. 10-2014-0125943, filed on Sep. 22, 2014, which is hereby incorporated by reference for all purposes as if fully set forth herein.

BACKGROUND

Field

Exemplary embodiments of the present invention relate to a liquid crystal display device configured to feedback control a common voltage, and a driving method thereof.

Discussion of the Background

A liquid crystal display device is a device that displays information by utilizing a change in optical characteristics of liquid crystals in response to an applied voltage. A liquid crystal display device may be miniaturized more easily than a cathode ray tube (CRT), thereby replacing CRTs as a display device for mobile information devices, office devices, computers, televisions, and so forth.

Liquid crystal display devices may be driven in an active matrix method which uses Thin-Film Transistors (TFTs) as switching devices, and liquid crystal cells display images on a display panel by changing their transmissivity based on a potential difference between a data voltage provided to a pixel electrode and a common voltage provided to a common electrode.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present invention provide a liquid crystal display device configured to feedback control a common voltage, and a driving method thereof.

Additional aspects of the present invention will be set forth in the detailed description which follows, and, in part, will be apparent from the disclosure, or may be learned by practice of the inventive concept.

According to an exemplary embodiment of the present invention, a liquid crystal display device includes a display panel including data lines and gate lines intersecting the data lines, a gate driver configured to sequentially apply a scan signal to the gate lines, a data driver configured to apply data voltages corresponding to each gate line to the data lines, a timing controller configured to control the gate driver and the data driver, and output feedback control signals corresponding to each gate lines based on first frame voltages corresponding to a first frame, a power source supply circuit configured to supply a positive power source and a negative power source, and determine a voltage level of the positive power source and the negative power source based on a logical value of each feedback control signals, and a common voltage feedback circuit configured to receive the positive power source and the negative power source from the power source supply circuit, receive a reference voltage and a common voltage from the display panel, and output an amplified feedback signal corresponding to a voltage level difference between the reference voltage and the common voltage, in which the display panel is configured to display the first frame, apply a common voltage that is feedback controlled based on the feedback signal, and then display a second frame.

The timing controller may be configured to output a feedback control signal including a first logical value when each gate lines satisfies a first condition, and a feedback control signal including a second logical value when each gate line does not satisfy the first condition, the first condition of a first gate line is satisfied when, among the data voltages arranged in the first gate line, a number of data voltages that satisfies a second condition is greater than a reference number, and the second condition is satisfied when the data voltages arranged in the first gate line has a voltage level difference greater than a reference voltage with respect to a corresponding data voltage arranged in a second gate line and in the same data line.

The power source supply circuit may be configured to determine a voltage level of the positive power source as a first positive voltage level, and a voltage level of the negative power source as a first negative voltage level in response to receiving the feedback control signal comprising a first logical value, a voltage level of the positive power source as a second positive voltage level, and a voltage level of the negative power source as a second positive voltage level in response to receiving the feedback control signal comprising a second logical value, and a voltage level difference between the first positive voltage level and the first negative voltage level is greater than a voltage level difference between the second positive voltage level and the second negative voltage level.

The first positive voltage level may be a gate on voltage level (Von), first negative voltage level may be an inverted gate off voltage level (−Voff), the second positive voltage level being an analogue driving voltage level (AVdd), and the second negative voltage level being a ground voltage level.

The common voltage feedback circuit may include an operational amplifier including a non-inverting signal input terminal configured to receive the reference voltage, an inverting signal input terminal configured to receive the common voltage, a positive power source supply terminal configured to receive the positive power source, a negative power source supply terminal configured to receive the negative power source, and an output terminal configured to amplify a voltage level difference between the reference voltage and the common voltage, and output the amplified voltage level difference.

The power source supply circuit may include a positive switch circuit configured to electrically connect at least one of a first positive voltage and a second positive voltage to the positive power source supply terminal, and a negative switch circuit configured to electrically-connect at least one of a first negative voltage and a second negative voltage to the negative power source supply terminal.

The second frame may be displayed after the first frame is displayed.

The second gate line may be adjacent to the first gate line.

According to an exemplary embodiment of the present invention, a method for driving a liquid crystal display device may include providing a display panel comprising data lines and gate lines intersecting the data lines, in which data voltages corresponding to each gate line are applied to the data lines, outputting feedback control signals corresponding to each gate lines based on first frame voltages corresponding to a first frame, determining voltage levels of a positive power source and a negative power source based on a logical value of each feedback control signal, supplying the positive power source and the negative power source, receiving the positive power source and the negative power source, and a reference voltage and a common voltage from the display panel, outputting a feedback signal comprising an amplified voltage level difference between the reference voltage and the common voltage, and displaying a second frame based on the feedback controlled common voltage according to the feedback signal, the second frame being displayed after the first frame.

Outputting feedback control signals may further include outputting a control signal comprising a first logical value when each gate line satisfies a first condition, and outputting a control signal comprising a second logical value when each gate line does not satisfies the first condition, the first condition of a first gate line is satisfied when a number of data voltages that satisfies a second condition is greater than a reference number among the data voltages arranged in the first gate line, the second condition is satisfied when the data voltage arranged in the first gate line has a voltage level difference greater than a reference voltage with respect to a corresponding data voltage arranged in a second gate line and in the same data line.

Supplying of a positive power source and a negative power source may further include setting a voltage level of the positive power source as a first positive voltage level, and a voltage level of the negative power source as a first negative voltage level, in response to receiving the feedback control signal having a first logical value, and setting a voltage level of the positive power source as a second voltage level, and a voltage of the negative power source as a second negative voltage level, in response to receiving the feedback control signal having a second logical value, and a voltage level between the first positive voltage level and the first negative voltage level is greater than a voltage level difference between the second positive voltage level and the second negative voltage level.

Supplying of a positive power source and a negative power source may further include setting a voltage level of the positive power source as +Vssref+(p−k)Vstep, and setting a voltage level of the negative power source as −Vssref−(p−k)Vstep, in which +Vssref is a positive voltage level reference, −Vssref is a negative voltage level reference, Vstep is a voltage level change width, p is a number of the logical value that the feedback control signal may have, p being a positive integer, and k is the sequence of the logical value among p, k being a positive integer less than or equal to p.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
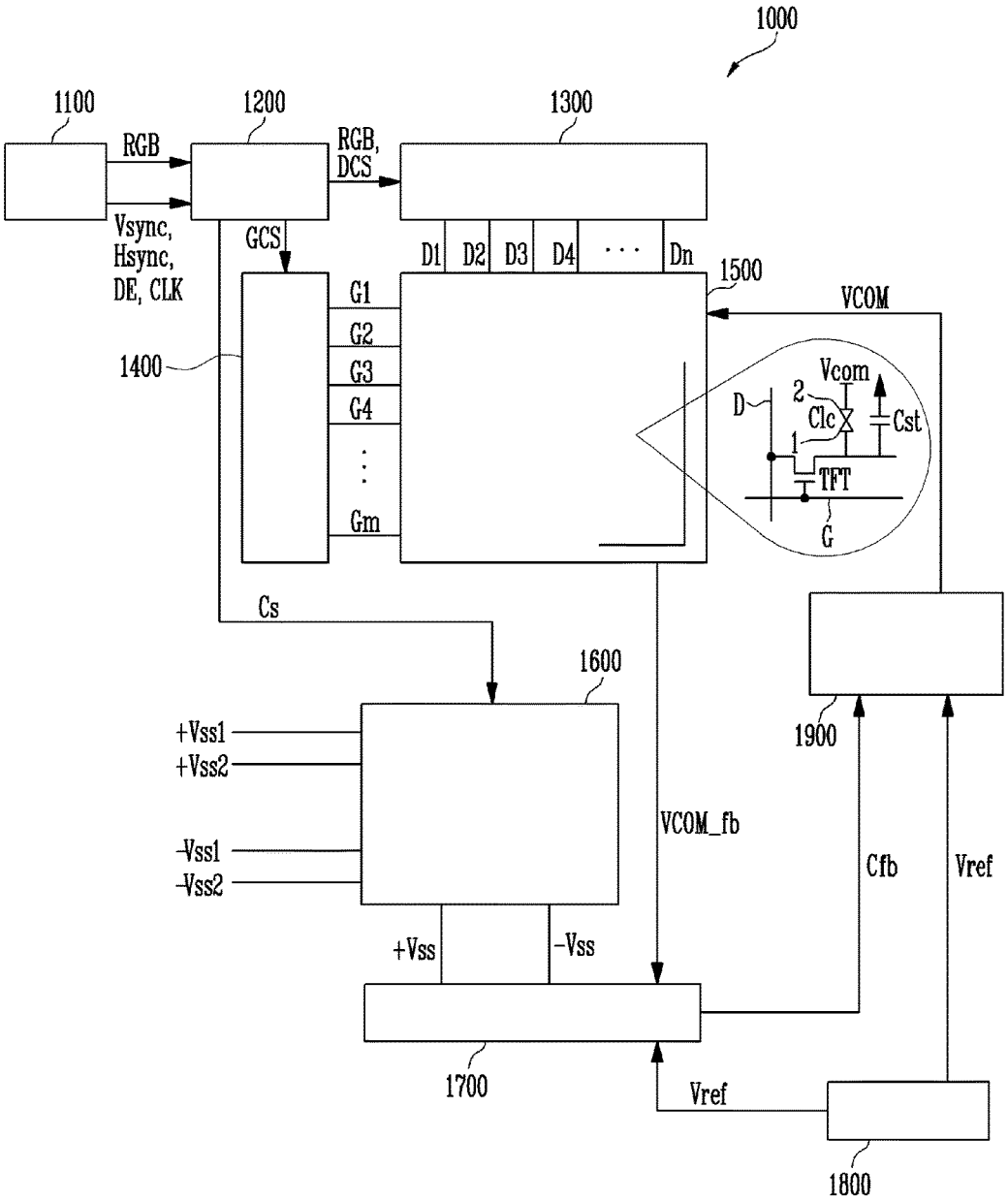
FIG. 1 is a block diagram of a liquid crystal display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
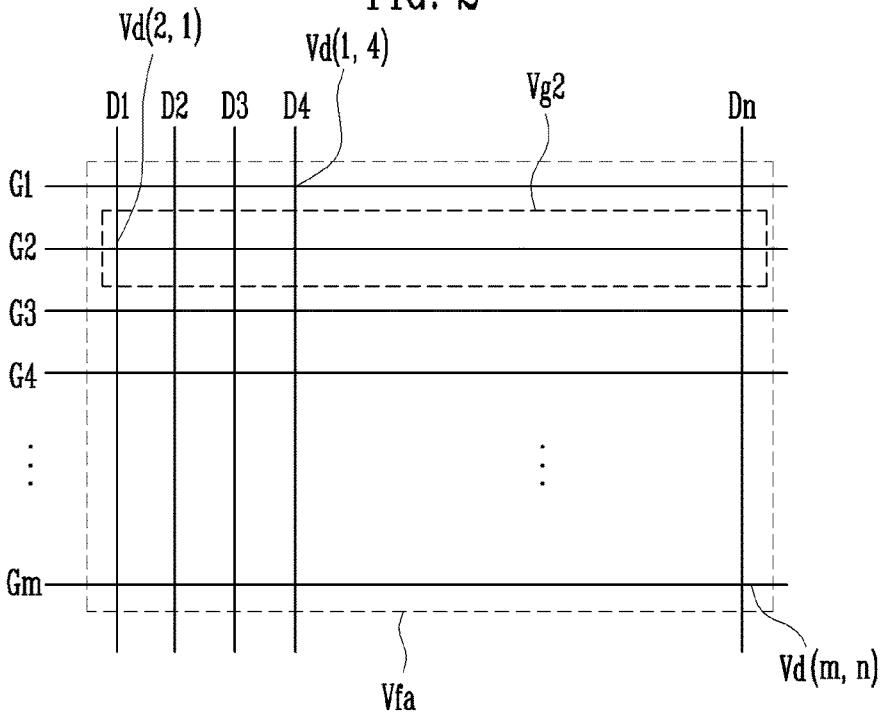
FIG. 2 is a diagram illustrating generation of feedback control signals based on frame voltages applied to a display panel according to an exemplary embodiment of the present invention.

FIG. 1 is a block diagram of a liquid crystal display device according to an exemplary embodiment of the present invention. Referring to FIGS. 1 and 2, a liquid crystal display device 1000 includes a host 1100, a timing controller 1200, a data driver 1300, a gate driver 1400, a display panel 1500, a power source supply circuit 1600, a common voltage feedback circuit 1700, a reference voltage generating circuit 1800, and a common voltage compensation circuit 1900.

The host 1100 may receive an electric signal corresponding to a screen to be displayed, and provide the electric signal to the timing controller 1200. The host 1100 may convert image data (RGB) input from an external video source device that may include a System on Chip (SoC) with a scaler embedded thereto into a data format with a desired resolution to display the image on the display panel 1500. The host 1100 may provide image data (RGB), vertical sync signal (Vsync), horizontal sync signal (Hsync), data enable (DE) signal, dot clock (CLK), and so forth to the timing controller 1200 through an interface, such as an Low Voltage Differential Signaling (LVDS) interface or Transition Minimized Differential Signaling (TMDS) interface.

The timing controller 1200 receives timing signals (Vsync, Hsync, DE, CLK) from the host 1100, and may create timing control signals to control an operation timing of the data driver 1300 and gate driver 1400. The timing control signals may include a gate timing control signal (GCS) for controlling an operation timing of the gate driver 1400, a data timing control signal (DCS) for controlling an operation timing of the data driver 1300, and a polarity of a data voltage. The gate timing control signal (GCS) may be applied to a gate drive IC and control the gate driver IC to generate the first gate pulse. The data timing control signal (DCS) may control a timing of starting a data sampling of the data driver 1300. Furthermore, the data timing control signal (DCS) may output image data (RGB) to the data driver 1300 to display an image on the display panel 1500.

The timing controller 1200 may analyze the image data (RGB) into frame units for feedback of a common voltage. The timing controller 1200 may output feedback control signals (Cs1 to Csm, hereinafter referred to as "Cs") corresponding to each gate line (G1 to Gm, hereinafter referred to as "G"), based on frame voltages (Vfa) corresponding to an $a^{th}$ frame ("a" being a positive integer). When each gate line (G) satisfies a first condition, the timing controller 1200 may output a feedback control signal having a first logical value, since a strong feedback control may be required, and when the gate line (G) does not satisfy the first condition, the timing controller 1200 may output a feedback control signal having a second logical value, since a strong feedback may not be required. The first condition and a method of satisfying the first condition will be described below with respect to the timing controller 1200 illustrated in FIG. 1.

The data driver 1300 may latch the image data (RGB) input from the timing controller 1200 in response to the data timing control signal (DCS). The data driver 1300 may include source drive ICs that are electrically connected to data lines (D1 to Dn, hereinafter referred to as "D") of the display panel 1500 by a Chip on Glass (COG) process or Tape Automated Bonding (TAB) process.

The gate driver 1400 may apply a scan signal to the gate lines (G) sequentially in response to the gate timing control signal (GCS). The gate driver 1400 may be directly formed on a TFT array substrate of the display panel 1500 in a Gate In Panel (GIP) method or be electrically connected to the gate lines (G1 to Gm) of the display panel 1500 by the TAB process.

The display panel 1500 may include a liquid crystal layer formed between two sheets of substrates. The display panel 1500 may further include data lines (D), gate lines (G) that intersect the data lines (D), a TFT formed at an intersection of the data lines (D) and the gate lines (G), a liquid crystal cell (Clc), and a storage capacitor (Cst) connected to the TFT. The liquid crystal cells (Clc) may be connected to the TFT and are driven by an electric field between a pixel electrode 1 and common electrode 2. The storage capacitor (Cst) may be connected to the pixel electrode 1 and a lower common electrode, and maintain a voltage charged in the pixel electrode 1 for a period of time.

The power source supply circuit 1600 may determine a voltage level of a positive power source (+Vss) and a negative power source (−Vss), and supply the determined positive power source (+Vss) and the negative power source (−Vss) to the common voltage feedback circuit 1700. According to the exemplary embodiment illustrated in FIG. 1, the power source supply circuit 1600 may receive a first positive voltage level (+Vss1), a second positive voltage level (+Vss2), a first negative voltage level (−Vss1), and a second negative voltage level (−Vss2). When the power source supply circuit 1600 receives a feedback control signal having a first logical value, the power source supply circuit 1600 may determine a voltage level of the positive power source (+Vss) as a first positive voltage level (+Vss1), and the negative power source (−Vss) as a first negative voltage level (−Vss1) as a strong feedback is required. When the power source supply circuit 1600 receives the control signal having a second logical value, the power source supply circuit 1600 may determine a voltage level of a positive power source (+Vss) as a second positive voltage level (+Vss2), and a negative power source (−Vss) as a second negative voltage level (−Vss2). A voltage level difference between the positive power source (+Vss) and the negative power source (−Vss) may be proportionate to a changeable width of a feedback signal (Cfb), and thus the voltage level difference between the first positive voltage level (+Vss1) and the first negative voltage level (−Vss1) may be greater than the voltage level difference between the second positive voltage level (+Vss2) and the second negative voltage level (−Vss2).

The common voltage feedback circuit 1700 may feedback control a common voltage that is subject to a voltage level change from coupling with data voltages. The common voltage feedback circuit 1700 may receive the positive power source (+Vss) and negative power source (−Vss) from the power source supply circuit 1600, and receive a common voltage (VCOM_fb) from the display panel 1500 and a reference voltage (Vref) from the reference voltage generating circuit 1800, and output a feedback signal (Cfb) that has been amplified by a amplification ratio corresponding to a difference between the reference voltage (Vref) and the common voltage (VCOM_fb).

The reference voltage generating circuit 1800 may generate the reference voltage (Vref) which sets a voltage level to be provided to the display panel 1500, and supply the reference voltage (Vref) to the common voltage feedback circuit 1700 and the common voltage compensation circuit 1900.

The common voltage compensation circuit 1900 may supply a common voltage (VCOM) based on the reference voltage (Vref) and feedback signal (Cfb). The feedback control based on the feedback signal (Cfb) compensates a voltage level change of the common voltage (VCOM) from the coupling.

After displaying an $a^{th}$ frame (a first frame), the display panel 1500 may apply the common voltage (VCOM) that has been feedback controlled by the feedback signal (Cfb) generated based on frame voltages (Vfa) corresponding to the $a^{th}$ frame, and displays a $b^{th}$ frame (b being a positive integer greater than a). The $b^{th}$ frame (a second frame) may be displayed after the $a^{th}$ frame is displayed.

FIG. 2 is a diagram illustrating generation of feedback control signals based on frame voltages applied to a display panel according to an exemplary embodiment of the present invention. Referring to FIG. 2, a data voltage corresponding to a first gate line G1 and a fourth data line D4 is defined as Vd(1,4). Data voltages (Vg2) corresponding to a second gate line G2 are defined as Vd(2, 1) to Vd(2, n). Frame voltages (Vfa) corresponding to an $a^{th}$ frame are defined as data voltages (Vg1 to Vgm) corresponding to a first to $m^{th}$ gate lines (G1 to Gm). Each of the feedback control signals (Cs1 to Csm) may be generated based on the corresponding data voltages (Vg1 to Vgm). The second gate line G2 is adjacent to the first gate line G1.

Referring back to FIG. 1, the timing controller 1200 outputs a feedback control signal (Cs) corresponding to each gate line (G), in which its logical value is based on whether or not the data voltages (Vd(k, 1) to Vd(k, n)) corresponding to a certain gate line (Vgk) satisfies a first condition. For example, among the data voltages (Vd(2,1) to Vd(2, n)) corresponding to a second gate line (G2), when a number of data voltages that satisfies a second condition is greater than a reference number, the first condition is satisfied, and a feedback control signal (Cs2) corresponding to the second gate line (G2) may have a first logical value. The second condition may be satisfied when a voltage level difference between the data voltage and a neighboring data voltage with respect to a data line (D) has a voltage level difference greater than a reference voltage level. For example, data voltage Vd(2, 1) neighbors data voltage Vd(1, 1) that corresponds to gate line (G1), and both data voltages Vd(2, 1) and Vd(1, 1) are applied by the same data line D1. When a voltage level difference between data voltage Vd(2, 1) and the neighboring data voltage Vd(1, 1) is greater than the reference voltage level, data voltage Vd(2, 1) satisfies a second condition, and may be counted with respect to the first condition.

When each feedback control signal (Csk, "k" being a positive integer) corresponding to a gate line Gk has a first logical value, corresponding data voltages (Vd(k, 1) to Vd(k, n)) are determined to be different from neighboring data voltages (Vd(k−1, 1) to Vd(k−1, n)) corresponding to gate line (Gk−1). Accordingly, based on a feedback control signal (Cs) an index (k) of a gate line that includes data voltages which exceed the reference number (gate line where there is great data transition) may be identified, and based on the index (k), a location that includes great data transition in an $a^{th}$ frame may be identified.

According to an exemplary embodiment of the present invention, data voltage Vd(k+1, 1) corresponding to gate line (Gk+1) may be a neighboring data voltage with respect to data voltage Vd(k, 1) corresponding to gate line (Gk), in which a scan signal is applied to the data voltage Vd(k, 1) before being applied to the data voltage Vd(k+1, 1). When a voltage level difference between data voltage Vd(k, 1) and data voltage Vd(k+1, 1) is greater than a reference voltage level, the data voltage Vd(k, 1) may satisfy the second condition illustrated above with reference to the exemplary embodiment of FIG. 1, and be counted as a number with respect to the first condition illustrated above with reference to the exemplary embodiment of FIG. 1, which determines whether, among data voltages corresponding to a gate line (Gk), a number of data voltages satisfying the second condition is greater than a reference number to determine logical value of a feedback control signal (Csk).

Figure 3:
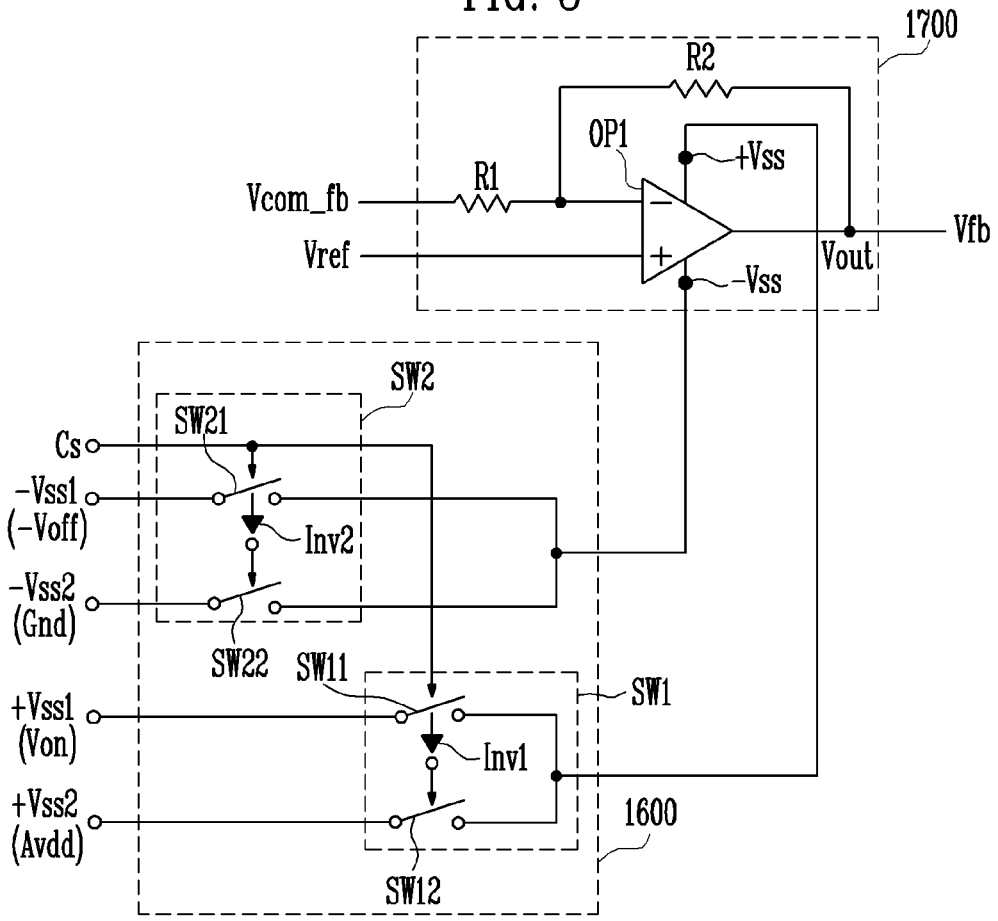
FIG. 3 is a circuit diagram of a power source supply circuit and a common voltage feedback circuit of a liquid crystal display device according to an exemplary embodiment of the present invention.

FIG. 3 is a circuit diagram of a power source supply circuit 1600 and common voltage feedback circuit 1700 in a liquid crystal display device according to an exemplary embodiment of the present invention. Referring to FIG. 3, the power source supply circuit 1600 may include a positive switch circuit (SW1) and negative switch circuit (SW2), and the common voltage feedback circuit (1700) may include an operational amplifier (OP1), a first resistance (R1), and a second resistance (R2). The power source supply circuit 1600 may receive and transmit a feedback control signal (Cs) to the positive switch circuit (SW1) and negative switch circuit (SW2). The positive switch circuit (SW1) may include switches (SW11, SW12), and an inverter (Inv1). The inverter (Inv1) may invert a logical value of the feedback control signal (Cs). When a feedback control signal (Cs) having a first logical value is input, a feedback control signal (Cs) having a second logical value may be output. When a feedback control signal (Cs) having a second logical value is input, a feedback control signal (Cs) having a first logical value may be output. When the switch (SW11) receives the feedback control signal (Cs), the switch (SW11) may be turned on when the feedback control signal (Cs) has a first logical value. When the switch (SW12) receives a reverted feedback control signal (Cs), the switch (SW12) may be turned on when the reverted feedback control signal (Cs) has a second logical value. Accordingly, when the power source supply circuit 1600 receives a feedback control signal (Cs) having a first logical value, a voltage level of a positive power source (+Vss) may be determined as a first positive voltage level (+Vss1). Furthermore, when the power source supply circuit 1600 receives a feedback control signal (Cs) having a second logical value, a voltage level of the positive power source (+Vss) may be determined as a second positive voltage level (+Vss2). The negative switch circuit (SW2) may include switches (SW21, SW22) and an inverter (Inv2). As the switches (SW21, SW22) and the inverter (Inv2) have substantially similar characteristics and operations with the switches (SW11, SW12) and the inverter (Inv1) of the positive switch circuit (SW1) described above, repeated description of the substantially similar elements and operations will be omitted. When the power source supply circuit 1600 receives a feedback control signal (Cs) having the first logical value, a voltage level of a negative power source (−Vss) may be determined as a first negative voltage level (−Vss1). When the power source supply circuit 1600 receives a feedback control signal (Cs) having a second logical value, a voltage level of a negative power source (−Vss) may be determined as a second negative voltage level (−Vss2). A voltage level used in a general liquid crystal display device may use a gate on voltage level (Von) as a first positive voltage level (+Vss1), a reverted gate off voltage (−Voff) as a first negative voltage level (−Vss1), an analogue driving voltage level (AVdd) as a second positive voltage level (+Vss2), and a ground voltage level (Gnd) as a second negative voltage level (−Vss2).

In the common voltage feedback circuit 1700, an operational amplifier (OP1) includes a non-invert signal input terminal (+), an invert signal input terminal (−), a positive power source supply terminal (+Vss), a negative power source supply terminal (−Vss), and an output terminal (Vout). A reference voltage (Vref) may be input to the non-invert signal input terminal (+), and a common voltage (VCOM_fb) from the display panel may be input to the invert signal input terminal (−). A positive power supply (+Vss) may be input to the positive power source supply terminal (+Vss), and a negative power source (−Vss) may be input to the negative power source supply terminal (−Vss). A common voltage (VCOM_fb) from the display panel may be applied to a terminal of a first resistance (R1), and an invert signal input terminal (−) is connected to another terminal of the first resistance (R1). A second resistance (R2) may connect the output terminal (Vout) and the invert signal input terminal (−). The voltage level of the output terminal (Vout) may be (R2/R1)(Vref−VCOM_fb). However, the actual voltage level in output may depend on the voltage level of the positive power source (+Vss) and negative power source (−Vss) supplied to the operational amplifier (OP1).

FIG. 4 are schematic views illustrating changes in a common voltage due to coupling, and changes in a common voltage due to a feedback signal in a liquid crystal display device according to an exemplary embodiment of the present invention.

Figure 4A:
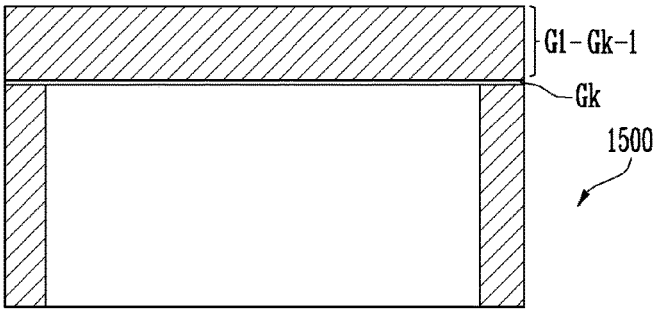
FIGS. 4A, 4B, 4C, 4D, 4E, and 4F are schematic views illustrating changes in a common voltage due to coupling and a feedback signal in a liquid crystal display device according to an exemplary embodiment of the present invention.

FIG. 4A is a schematic view of a screen displayed on the display panel 1500 displaying an image that corresponds to an $a^{th}$ frame and a $b^{th}$ frame that is displayed after the $a^{th}$ frame. For the convenience of the description, the image corresponding to the $a^{th}$ frame and the image corresponding to the $b^{th}$ frame are assumed to be the same. A portion of the screen that corresponds to a certain gate line (Gk) may be displayed in black and white, and a portion that corresponds to gate lines (G1 to Gk−1) in which a scan signal are applied prior to the certain gate line (Gk) may be displayed in black. When the timing controller 1200 analyzes the $a^{th}$ frame voltages Vfa, the certain gate line (Gk) may be determined as having a great data transition.

Figure 4B:
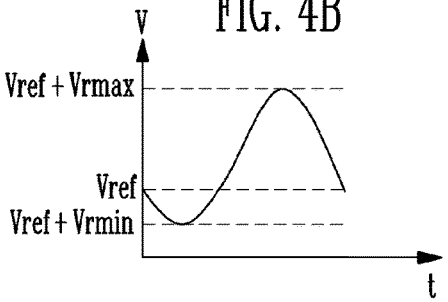

FIG. 4B is a graph illustrating a common voltage without a feedback control. Coupling with data voltages (Vgk−1) affects a voltage level of the common voltage, and a voltage level change (Vr) due to the coupling may be greater than its minimum value (Vrmin) and smaller than its maximum value (Vrmax).

Figure 4C:
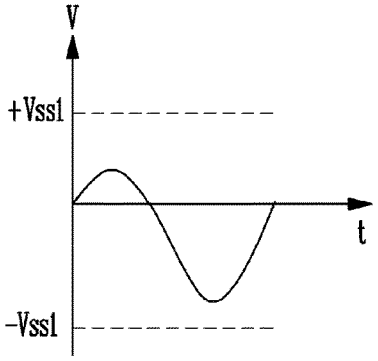

FIG. 4C is a graph illustrating a voltage level of a feedback signal (Cfb) when a feedback control signal (Csk) has a first logical value. Since a voltage difference between a first positive voltage level (+Vss1) and a first negative voltage level (−Vss1) is large, a voltage level of an output terminal (Vout), that is, (R2/R1)(Vref-VCOM_fb) may not be limited by the first positive voltage level (+Vss1) and the first negative voltage level (−Vss1).

Figure 4D:
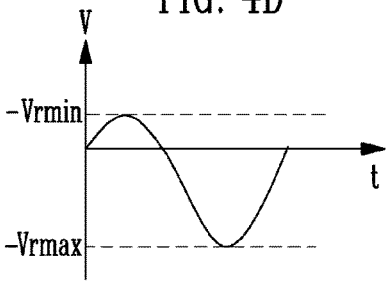

FIG. 4D is a graph illustrating a change of a common voltage level due to a feedback signal in displaying a $b^{th}$ frame when a feedback control signal (Csk) has a first logical value. A common voltage level due to a feedback signal may have a value between (−Vrmax) and (−Vrmin). Since a voltage level of a feedback signal (Cfb) may not be limited by a voltage level (+Vss1, −Vss1) of supplied power sources (+Vss, −Vss), a voltage level change (Vr) due to coupling may be compensated.

Figure 4E:
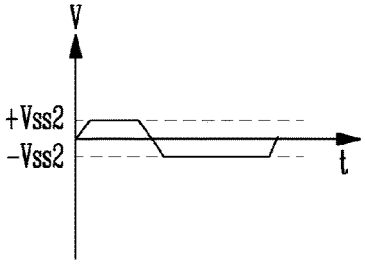

FIG. 4E is a graph illustrating a voltage level of a feedback signal (Cfb) when a feedback control signal (Csk) has a second logical value. Since a voltage difference between a second positive voltage level (+Vss2) and a second negative voltage level (−Vss2) is small, a voltage level of an output terminal (Vout), that is, (R2/R1)(Vref−VCOM_fb) may not be limited by the second positive voltage level (+Vss2) and the second negative voltage level (−Vss2).

Figure 4F:
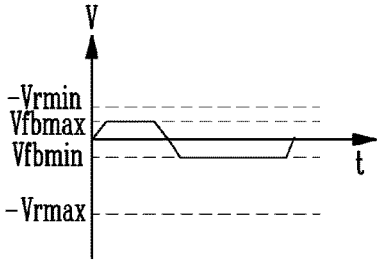

FIG. 4F is a graph illustrating a level change of a common voltage due to a feedback signal in displaying a $b^{th}$ frame, when a feedback control signal (Csk) has a second logical value. A common voltage level (Vf) due to a feedback signal may be limited between a minimum value (Vfbmin) to a maximum value (Vfbmax). Vfbmin is greater than −Vrmax, and Vfbmax is smaller than −Vrmin, and thus a voltage level change (Vr) due to coupling may not be fully compensated.

A liquid crystal display device according to an exemplary embodiment of the present invention may determine a feedback control signal (Cs) as a first logical value when there is great data transition in an $a^{th}$ frame to restrict a common voltage change due to coupling, and determine a feedback control signal (Cs) as a second logical value when the data transition is small to reduce power consumption.

Figure 5:
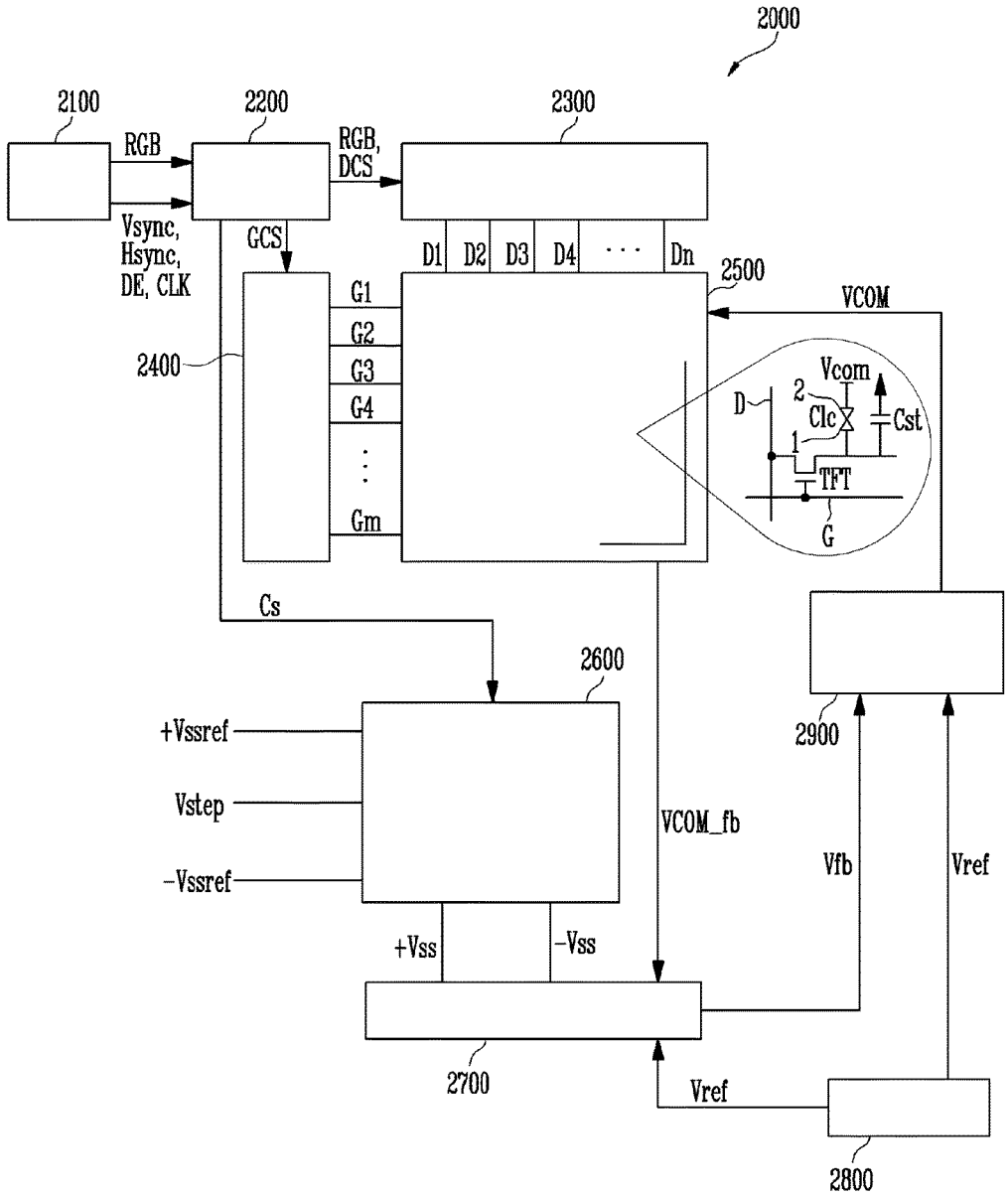
FIG. 5 is a block diagram of a liquid crystal display device according to an exemplary embodiment of the present invention.

FIG. 5 is a block diagram of a liquid crystal display device according to an exemplary embodiment of the present invention. A liquid crystal display device 2000 may include a host 2100, a data driver 2300, a gate driver 2400, a display panel 2500, a reference voltage generating voltage 2800, and a common voltage compensation circuit 2900, which are substantially similar to the corresponding elements illustrated with reference to FIG. 1. Accordingly, repeated description of the substantially similar elements and operations illustrated with reference to FIG. 1 will be omitted.

The timing controller 2200 may analyze image data (RGB) in frame units for feedback of a common voltage, and output feedback control signals (Cs) corresponding to each gate line (G). Each feedback control signal (Cs) may have p logical values ("p" is a positive integer) ranging from a first logical value to a $p^{th}$ logical value, and the logical value may be proportionate to or inversely proportionate to the required intensity of feedback control.

When a strongfeedback control is necessary, a feedback control signal having a first logical value may be output, and when a weak feedback control is required, a feedback control signal having a $p^{th}$ logical value may be output.

The power source supply circuit 2600 may determine a voltage level of a positive power source (+Vss) and a negative power source (−Vss) based on the received feedback control signal (Cs). The power source supply circuit 2600 may receive a positive voltage level reference (+Vssref), a negative voltage level reference (−Vssref), and a voltage level change width (Vstep). A voltage level of the positive power source (+Vss) corresponding to a feedback control signal having a $k^{th}$ logical value may be determined as (+Vssref+(p−k)Vstep), and a voltage level of the negative power source (−Vss) may be determined as (−Vssref−(p−k) Vstep).

The common voltage feedback circuit 2700 may receive the positive power source (+Vss) and the negative power source (−Vss) from the power source supply unit 2600, and receive a reference voltage (Vref) and common voltage (VCOM_fb) from the display panel 2500. The common voltage feedback circuit 2700 may output a feedback signal (Cfb) of which a difference between the reference voltage (Vref) and common voltage (VCOM_fb) may be amplified by a predetermined amplification width. A maximum and minimum value of a voltage level of a feedback control signal (Cfb) may be determined based on a logical value of a feedback control signal (Cs).

Figure 6:
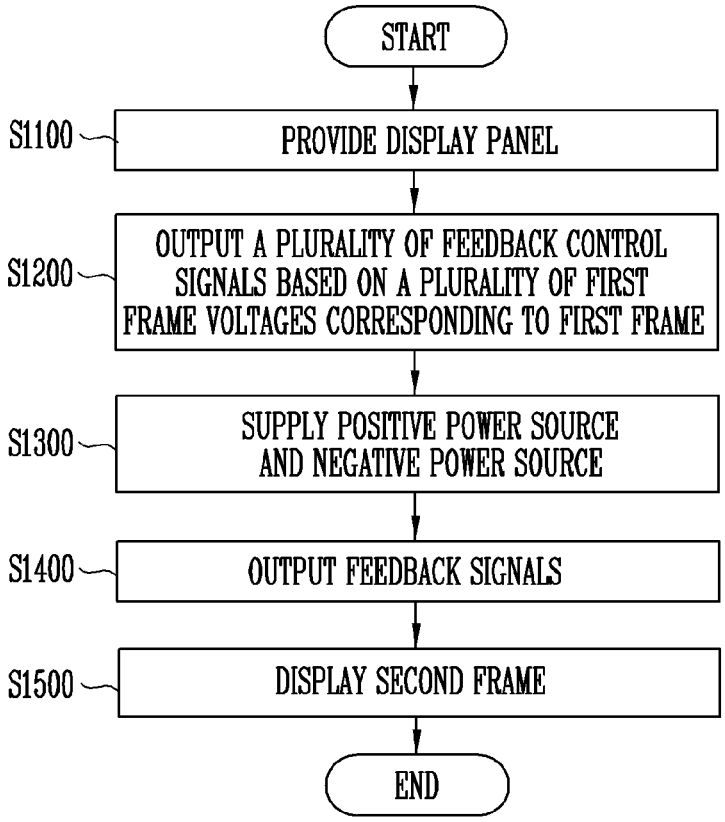
FIG. 6 is a flowchart for driving a liquid crystal display device according to an exemplary embodiment of the present invention.

FIG. 6 is a flowchart illustrating a method for driving a liquid crystal display device according to an exemplary embodiment of the present invention. Hereinafter, the method will be described with reference to FIGS. 1 to 4.

At step S1100, a display panel 1500 may be provided. The display panel 1500 may include data lines (D) and gate lines (G) intersecting the data lines (D). Data voltages (Vsk) corresponding to each gate line (Gk) may be applied to the data lines (D).

At step 1200, feedback control signals (Cs) may be output based on frame voltages (Vfa) corresponding to an $a^{th}$ frame. The feedback control signals (Cs1 to Csm) correspond to each gate line (G1 to Gm), and may identify a location having great data transition in the $a^{th}$ frame based on a logical value and index (1 to m) of the feedback control signals (Cs). When a corresponding gate line (G) satisfies a first condition illustrated above with reference to FIG. 1, each of the feedback control signals (Cs) may require a strong feedback control, and thus output a feedback control signal having a first logical value. When the corresponding gate line (G) does not satisfy the first condition, each of the feedback control signals (Cs) may not require a strong feedback control, and thus output a feedback control signal having a second logical value. The method of determining the first \condition are substantially similar to the first condition illustrated above with reference to FIG. 1, and repeated description thereof will be omitted.

At step 1300, the power source supply circuit 1600 may determine a voltage level of a positive power source (+Vss) and negative power source (−Vss) based on the feedback control signals (Cs), and supplies the positive power source (+Vss) and negative power source (−Vss) of the determined voltage level to the common voltage feedback circuit 1700. When the feedback control signal (C) with a first logical value is input, a voltage level of the positive power source (+Vss) may be a first positive voltage level (+Vss1), and the voltage level of a negative power source (−Vss) may be a first negative voltage level (−Vss1). When the feedback control signal with a second logical value is input, the voltage level of a positive power source (+Vss) may be a second positive voltage level (+Vss2), and the voltage level of a negative power source (−Vss) may be a second negative voltage level (−Vss2). The voltage level with reference to the first positive voltage level (+Vss1), the first negative voltage level (−Vss1), the second positive voltage level (+Vss2), and the second negative voltage level (−Vss2) are substantially similar to those illustrated above with respect to FIG. 1, and repeated description thereof will be omitted.

At step S1400, the common voltage feedback circuit 1500 may receive the positive power source (+Vss) and negative power source (−Vss) from the power source supply circuit 1600, a reference voltage (Vref) and a common voltage (VCOM_fb) from the display panel 1500, and output a feedback signal (Cfb) that has been amplified by an amplification width corresponding to a difference between the reference voltage (Vref) and the common voltage (VCOM_fb). The voltage level of the feedback signal (Cfb) may be lower than the voltage level of the positive power source (+Vss), and greater than the voltage level of the negative power source (−Vss).

At step S1500, the display panel 1500 may apply the common voltage (VCOM) feedback controlled by the feedback signal (Cfb) and display a second frame ($b^{th}$ frame). The second frame may be displayed after the first frame ($a^{th}$ frame) is displayed. When the second frame is displayed after the first frame, the image of the second frame and the image of the first frame will be substantially similar to each other, and thus it may be possible to predict a location having a great data transition in the second frame, and when the predicted location is displayed, the common voltage (VCOM) may be strongly feedback controlled.

According to exemplary embodiment of the present invention, a liquid crystal display device may include data lines, and gate lines that intersect the data lines. The data lines and the gate lines may be electrically connected to thin-film transistors, in which a scan signal is sequentially applied to the gate lines. A common voltage may be applied to a common electrode, but the common voltage applied may change as it is coupled with changes of data voltages. Accordingly, an image to be displayed may be distorted as the data voltages affect the common voltage via a horizontal crosstalk.

According to exemplary embodiments of the present invention may improve feedback control of common voltages that are coupled by data voltages, thereby reducing the horizontal crosstalk phenomenon.

Although certain exemplary embodiments and implementations have been described herein, other embodiments and modifications will be apparent from this description. Accordingly, the inventive concept is not limited to such exemplary embodiments, but rather to the broader scope of the presented claims and various obvious modifications and equivalent arrangements.

What is claimed is:

1. A method for driving a liquid crystal display device, the method comprising:

providing a display panel comprising data lines and gate lines intersecting the data lines, wherein data voltages corresponding to each gate line are applied to the data lines;

outputting feedback control signals corresponding to each of the gate lines based on first frame voltages corresponding to a first frame;

determining voltage levels of a positive power source and a negative power source based on a logical value of each feedback control signal;

supplying the positive power source and the negative power source;

receiving the positive power source and the negative power source, and a reference voltage and a common voltage from the display panel;

outputting a feedback signal comprising an amplified voltage level difference between the reference voltage and the common voltage; and displaying a second frame based on the feedback controlled common voltage according to the feedback signal, the second frame being displayed after the first frame, wherein supplying of a positive power source and a negative power source further comprises:

setting a voltage level of the positive power source as +Vssref+(p−k)Vstep; and setting a voltage level of the negative power source as −Vssref−(p−k)Vstep, and wherein:

+Vssref is a positive voltage level reference;

−Vssref is a negative voltage level reference;

Vstep is a voltage level change width;

p is a number of the logical value that the feedback control signal may have, p being a positive integer; and k is the sequence of the logical value among p, k being a positive integer less than or equal to p.

2. The method according to claim 1, wherein:

outputting feedback control signals further comprises:

outputting a control signal comprising a first logical value when each gate line satisfies a first condition; and outputting a control signal comprising a second logical value when each gate line does not satisfies the first condition;

the first condition of a first gate line is satisfied when a number of data voltages that satisfies a second condition is greater than a reference number among the data voltages arranged in the first gate line; and the second condition is satisfied when the data voltage arranged in the first gate line has a voltage level difference greater than a reference voltage with respect to a corresponding data voltage arranged in a second gate line and in the same data line.

3. The method according to claim 2, wherein the second gate line is adjacent to the first gate line.

4. The method according to claim 1, wherein the second frame is displayed right after the first frame is displayed.

5. A liquid crystal display device, comprising:

a display panel comprising data lines and gate lines intersecting the data lines;

a gate driver configured to sequentially apply a scan signal to the gate lines;

a data driver configured to apply data voltages corresponding to each gate lines to the data lines;

a timing controller configured to control the gate driver and the data driver, and output feedback control signals corresponding to each gate line based on first frame voltages corresponding to a first frame;

a power source supply circuit configured to supply a positive power source and a negative power source, and determine a voltage level of the positive power source and the negative power source based on a logical value of each feedback control signals; and a common voltage feedback circuit configured to receive the positive power source and the negative power source from the power source supply circuit, receive a reference voltage and a common voltage from the display panel, and output an amplified feedback signal corresponding to a voltage level difference between the reference voltage and the common voltage, wherein the display panel is configured to display the first frame, apply a common voltage that is feedback controlled based on the feedback signal, and then display a second frame, wherein the power source supply circuit is configured to determine:

a voltage level of the positive power source as +Vssref+(p−k)Vstep; and a voltage level of the negative power source as −Vssref−(p−k)Vstep, and wherein:

+Vssref is a positive voltage level reference;

−Vssref is a negative voltage level reference;

Vstep is a voltage level change width;

p is a number of the logical value that the feedback control signal may have, p being a positive integer; and k is the sequence of the logical value among p, k being a positive integer less than or equal to p.

6. The liquid crystal display device according to claim 5, wherein:

the timing controller is configured to output a feedback control signal comprising a first logical value when each gate line satisfies a first condition, and a feedback control signal comprising a second logical value when each gate line does not satisfy the first condition;

the first condition of a first gate line is satisfied when, among the data voltages arranged in the first gate line, a number of data voltages that satisfies a second condition is greater than a reference number; and the second condition is satisfied when the data voltages arranged in the first gate line has a voltage level difference greater than a reference voltage with respect to a corresponding data voltage arranged in a second gate line and in the same data line.

7. The liquid crystal display device according to claim 6, wherein the second gate line is adjacent to the first gate line.

8. The liquid crystal display device according to claim 5, wherein:

the common voltage feedback circuit comprises an operational amplifier comprising:

a non-inverting signal input terminal configured to receive the reference voltage;

an inverting signal input terminal configured to receive the common voltage;

a positive power source supply terminal configured to receive the positive power source;

a negative power source supply terminal configured to receive the negative power source; and an output terminal configured to amplify a voltage level difference between the reference voltage and the common voltage, and output the amplified voltage level difference.

9. The liquid crystal display device according to claim 5, wherein the display panel displays the second frame after the first frame.

* * * * *